United States Patent [19]

Than

[11] 4,153,222

[45] May 8, 1979

[54] KITE REEL

[76] Inventor: Maung M. Than, 4456 E. Earll Dr., Phoenix, Ariz. 85018

[21] Appl. No.: 900,419

[22] Filed: Apr. 27, 1978

[51] Int. Cl.[2] ..... B65H 75/48
[52] U.S. Cl. ..... 242/96
[58] Field of Search ..... 242/96, 99, 84.8, 100; 244/153 A, 155 R, 155 A

[56] References Cited

U.S. PATENT DOCUMENTS

| | | | |
|---|---|---|---|
| 690,588 | 1/1902 | Krex | 242/96 |
| 2,475,656 | 7/1949 | Bidak | 242/96 |
| 4,014,477 | 3/1977 | Hyun | 242/96 |

*Primary Examiner*—Edward J. McCarthy
*Attorney, Agent, or Firm*—Harry M. Weiss

[57] ABSTRACT

A kite reel of reduced drag force which is light-weight and economical to produce. The reel is basically constructed of a plurality of wooden dowels providing a resilient strand bearing skin of a reel spindle.

10 Claims, 5 Drawing Figures

KITE REEL

BACKGROUND OF THE INVENTION

1. Field of the Invention

This invention relates to the act of kite flying and, more particularly, to an improved reel for kites.

2. Description of the Prior Art

In general, for flying kites higher and for larger kites a wire reel of larger size is required. In the context of this invention, a wire is a strand of indeterminate length and material. Thus, the wire may be of insulative non-metal or nonconductor metal material. It may be solid, tubular or woven. However, in general, the wire will be of a twisted or braided textile material as is most conventional. As reels of larger size are required because of the additional length and/or size of material, the drag force thereof increases. Thus, to reduce this force, the reel has been conventionally made even larger to reduce this force for a given size and length of wire.

SUMMARY OF THE INVENTION

Accordingly, it is an object of this invention to provide an improved kite reel.

A further object of this invention is to provide a kite reel having reduced drag force.

A still further object of this invention is to provide a kite reel which is light-weight relative to its wire handling capacity.

Another object of the invention is to provide a kite reel which is economical to produce.

Thus, in accordance with these objects there is provided a kite reel including a spindle with a shaft affixed thereto and extending outwardly from the end thereof to form a pair of handles. The spindle has a pair of circular discs forming end flanges therefor secured together by a plurality of cross braces, said cross braces being in a circular array about said shaft. The flanges each have a circular array of circular recesses on a side opposite to the side thereof facing the outwardly extending handles. A plurality of small rods engaged in said circular recesses and extending between said flanges to form the flexible skin for the spindle whereby when a wire is wound or unwound thereon or therefrom resilient tension is placed on said wire.

BRIEF DESCRIPTION OF THE DRAWING

Further objects and advantages of the invention will be understood from the following complete description thereof and from the drawing wherein.

COMPLETE DESCRIPTION

As abovementioned, for flying kites higher and for larger kites a wire reel of larger size is required. The wire may be of conductor or nonconductor material. It may be solid, tubular or woven. However, in general, the wire will be of a twisted or braided textile material as is most conventional. As reels of larger size are required because of the additional length and/or size of material, the drag force thereof increases. Thus, to reduce this force, the reel has been conventionally made even larger to reduce this force for a given size and length of wire.

Figure 1:
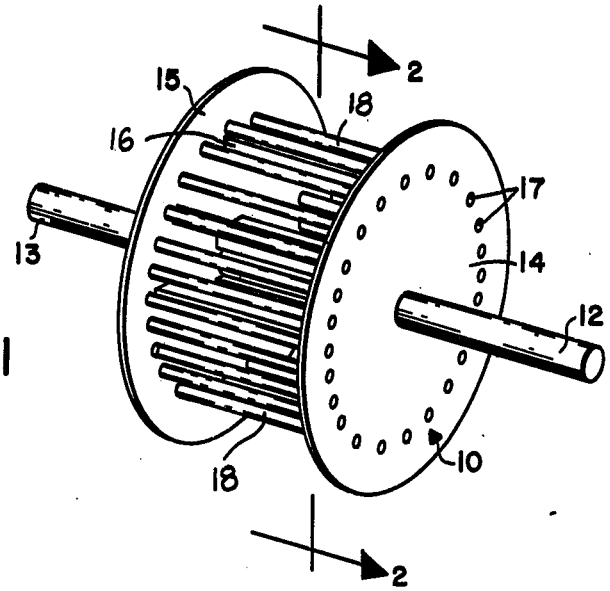
FIG. 1 is a perspective view of a kite reel in accordance with the invention.
Figure 2:
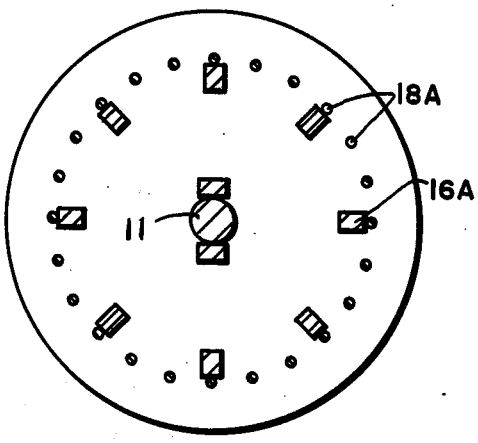
FIG. 2 is a cross-section thereof.

In accordance with the invention, a kite reel comprises a spindle 10 (FIG. 1) having a shaft 11 (FIG. 2) affixed thereto and extending outwardly from the end thereof to form a pair of handles 12 and 13. The spindle 10 includes a pair of circular discs 14 and 15 forming end flanges therefor secured together by a plurality of cross braces 16, said cross braces being in a circular array about said shaft 11. The flanges 14 and 15 each have a circular array of circular recesses 17 at least on a side opposite to the side thereof facing the outwardly extending handles. The recesses may extend entirely through the flanges.

A plurality of small rods 18 are engaged in said circular recesses and extend between said flanges to form the flexible skin for the spindle whereby when a wire can wind or unwind thereon or therefrom while resilient tension is placed on said wire. The circular recesses 17 usually extend through the flanges 14, 15 and rods are secured therein by an adhesive.

Figure 3:
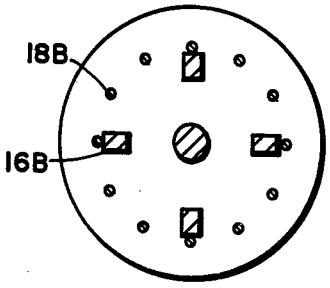
FIG. 3 is a cross-section similar to FIG. 3 of a further embodiment of the invention.

The rods 18 are wooden dowels of about ¼" diameter (FIG. 2) which are readily made and have the desired spring thereto. It is to be noted that one of the rods 18 is positioned radially outward of each of said cross braces 16. A comparison of FIGS. 2 and 3 demonstrates that the number of cross braces, N, is related to the number of rods, n, in accordance with the equation, $N=\frac{1}{3}n$. For the larger sizes as in FIG. 2, a pair of cross braces may extend between the flanges 14 and 15 immediately adjacent said shaft 11.

Figure 5:
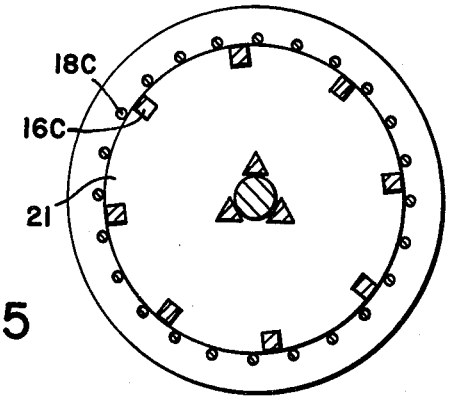
FIG. 5 illustrates a second embodiment of a kite reel in accordance with the present invention.

A size, larger than first embodiment is depicted in FIG. 5 includes a central or intermediate support disc 21 which is affixed to the central shaft and bears outwardly against the rods 18C to provide internal support therefor. In this case the cross braces 16C are in two parts with one part extending from the disc 21 to the end flange 14 and the other part from the disc to end flange 15.

Figure 4:
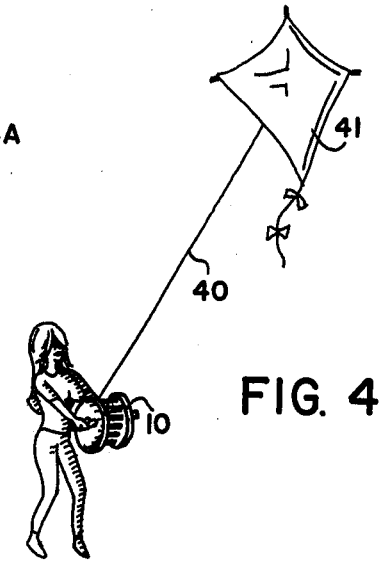
FIG. 4 is a pictorial view of use of the invention.

As depicted in FIG. 4, the kite reel spindle 10 may be held loosely in the two hands of a person while the wire 40 is pulled rapidly therefrom by the movement of the kite 41 upwardly and away from the person. Since the skin of dowel 18 puts little mass at the outer rim of the spindle 10 the angular momentum thereof is small. Also since the diameter of the wooden dowels is small, they are resilient and thereby reduce instantaneous tension on the wire since they yield as the wire is withdrawn.

Thus, it will be seen that there is provided an improved kite reel having reduced drag force which is light-weight relative to its wire handling capacity and is economical to produce.

While the invention has been described by way of the preferred embodiment thereof, it will be appreciated that certain modifications may be made therein without departing from the spirit and scope of the invention.

What is claimed is:

1. A kite reel comprising a spindle having a shaft affixed thereto and extending outwardly from the end thereof to form a pair of handles;

said spindle comprising a pair of circular discs forming end flanges therefor secured at least partly together by a plurality of cross braces said cross braces being in a circular array about said shaft; and a plurality of small rods extending between said flanges to form a flexible skin for the spindle whereby when a wire is wound or unwound thereon or therefrom resilient tension is placed on said wire.

2. A kite reel as recited in claim 1 wherein said rods are wooden dowels of ¼" diameter.

3. A kite reel as recited in claim 1 wherein one of said rods is positioned radially outward of each of said cross braces.

4. A kite reel as recited in claim 1 wherein said flanges each have a circular array of circular recesses on a side opposite to the side thereof facing the outwardly extending handles, and said rods engage in said circular recesses.

5. A kite reel as recited in claim 1 wherein said spindle further includes an intermediate support disc affixed to said shaft for bearing against the inside of said rods and internally supporting said rods.

6. A kite reel as recited in claim 5 wherein said cross braces are in two parts, one part extending from a first end flange to said disc and the other part extending from the other end flange to said disc.

7. A kite reel as recited in claim 1 and including a pair of cross braces extending between said flanges immediately adjacent to said shaft.

8. A kite reel as recited in claim 4 wherein said circular recesses extend through said flanges and said rods are secured therein.

9. A kite reel as recited in claim 8 wherein said rods are secured by adhesive.

10. A kite reel as recited in claim 8 wherein the number of cross braces, N, is related to the number of rods, n, in accordance with the equation, $N=\frac{1}{3}n$.

* * * * *